US008336703B2

(12) United States Patent
Pedrazzi et al.

(10) Patent No.: US 8,336,703 B2
(45) Date of Patent: Dec. 25, 2012

(54) SEPARATING UNIT FOR SEPARATING OPENING DEVICES TO BE APPLIED SINGLY TO RESPECTIVE PACKAGES OF POURABLE FOOD PRODUCTS

(75) Inventors: Alessandro Pedrazzi, Modena (IT); Marco Poppi, Modena (IT); Jonas Dickner, Helsingborg (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 12/664,161

(22) PCT Filed: Jun. 13, 2008

(86) PCT No.: PCT/EP2008/057511
§ 371 (c)(1),
(2), (4) Date: Dec. 11, 2009

(87) PCT Pub. No.: WO2008/152143
PCT Pub. Date: Dec. 18, 2008

(65) Prior Publication Data

US 2010/0170768 A1 Jul. 8, 2010

(30) Foreign Application Priority Data

Jun. 15, 2007 (EP) ..... 07425373

(51) Int. Cl.
*B65G 47/86* (2006.01)

(52) U.S. Cl. ..... 198/470.1; 198/478.1

(58) Field of Classification Search ..... None
See application file for complete search history.

(56) References Cited

U.S. PATENT DOCUMENTS 5,102,485 A 4/1992 Keeler et al.

(Continued)

FOREIGN PATENT DOCUMENTS

EP 0 508 222 A1 10/1992

(Continued)

OTHER PUBLICATIONS

International Search Report (PCT/ISA/210) for PCT/EP2008/057511 mailed Sep. 22, 2008.

(Continued)

*Primary Examiner* — Kavel Singh
(74) *Attorney, Agent, or Firm* — Buchanan Ingersoll & Rooney PC

(57) ABSTRACT

A unit (1) for separating opening devices (2) supplied in the form of a row (7) and to be applied singly to respective sealed packages (3) of pourable food products, the unit having a separating assembly (10), in turn having a first and a second jaw (40, 41) movable along a path (P) and defining a seat (42), which is movable between an open configuration, in which it receives an opening device (2) from the row (7) at a first station (I) along the path (P), and a closed configuration, in which it moves the opening device (2) singly along the path (P) to detach it from the rest of the row (7); the unit (1) also has elastic means (43) for loading at least the first jaw (40) towards the second jaw (41); a conveyor (13) for conveying the opening devices (2), and which is separate from the separating assembly (10); and at least a first cam (61) activated by the conveyor (13) and cooperating cyclically with a cam follower (38), integral with the first jaw (40), to move the first jaw (40), in opposition to the elastic means (43), away from the second jaw (41) and move the seat (42) into the open configuration.

20 Claims, 7 Drawing Sheets

U.S. PATENT DOCUMENTS

| | | | | |
|---|---|---|---|---|
| 5,297,375 | A | 3/1994 | Reil et al. | |
| 6,851,544 | B2 * | 2/2005 | Noll, Jr. | 198/470.1 |
| 7,412,813 | B2 | 8/2008 | Heil et al. | |

FOREIGN PATENT DOCUMENTS

| | | | |
|---|---|---|---|
| EP | 1 471 009 | A1 | 10/2004 |
| RU | 2005 135 656 | | 8/2006 |

OTHER PUBLICATIONS

Written Opinion (PCT/ISA/237) for PCT/EP2008/057511 mailed Sep. 22, 2008.

Decision on Grant issued on Jun. 1, 2012 by the Russian Patent Office in corresponding Russian Patent Application No. 2010101086.

* cited by examiner

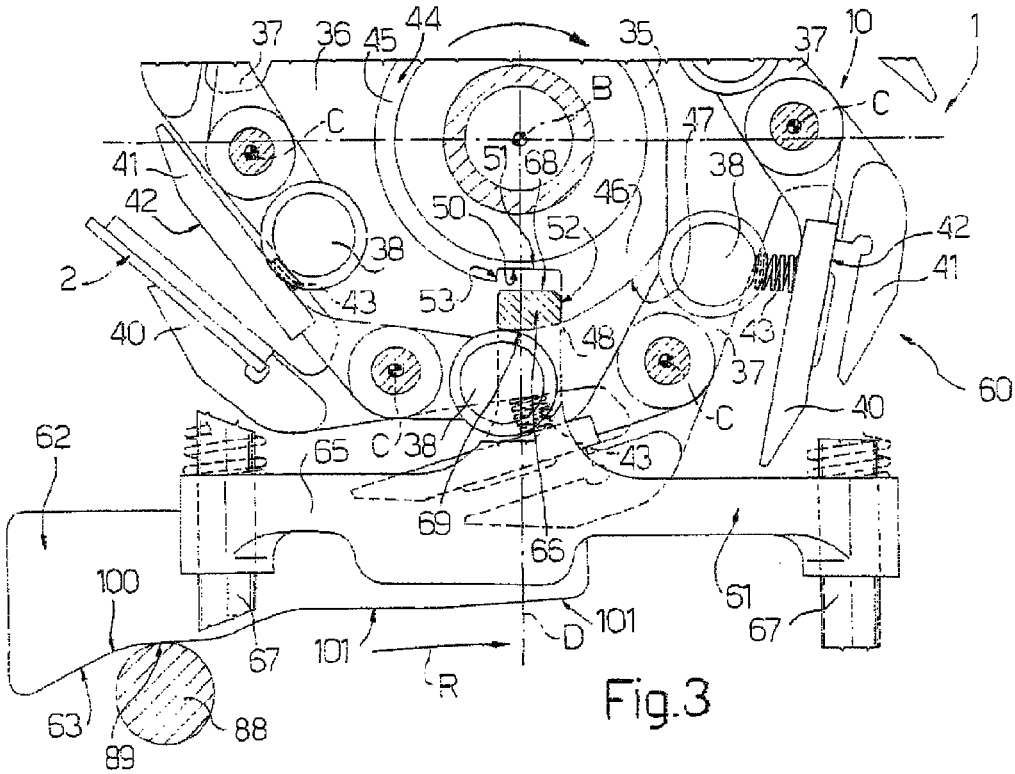
Fig.3
Fig.5
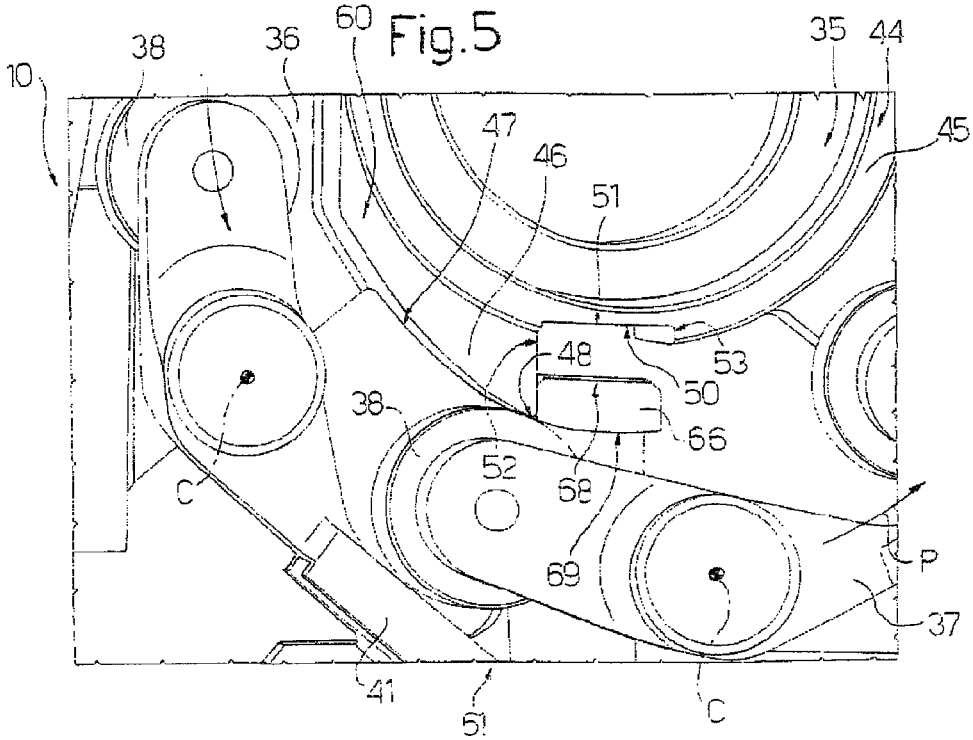

P
U
S
E
Q
13
70
71
72
73
74
75
76
77
78
79
80
81
88
90
2
3
4
5
6
12
14
F

SEPARATING UNIT FOR SEPARATING OPENING DEVICES TO BE APPLIED SINGLY TO RESPECTIVE PACKAGES OF POURABLE FOOD PRODUCTS

TECHNICAL FIELD

The present invention relates to a separating unit for separating opening devices to be applied singly to respective packages of pourable food products.

BACKGROUND ART

As is known, many pourable food products, such as fruit juice, UHT (ultra-high-temperature treated) milk, wine, tomato sauce, etc., are sold in sealed packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may comprise a layer of fibrous material, e.g. paper, or mineral-filled polypropylene material; and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; and the web of packaging material so sterilized is maintained in a closed, sterile environment, and is folded and sealed longitudinally to form a vertical tube.

The tube is filled with the sterilized or sterile-processed food product, and is sealed and subsequently cut along equally spaced cross sections to form pillow packs, which are then folded mechanically to form respective finished, e.g. substantially parallelepiped-shaped, packages.

Alternatively, the packaging material may be cut into blanks, which are formed into packages on forming spindles, and the packages are filled with the food product and sealed. One example of this type of package is the so-called "gable-top" package known by the trade name Tetra Rex (registered trademark).

Once formed, the above packages may undergo further processing, such as the application of a reclosable opening device.

At present, the most commonly marketed opening devices comprise a frame defining a pour opening and fitted about a hole or a pierceable or removable portion of a top wall of the package; and a cap hinged or screwed to the frame, and which is removable to open the package. Alternatively, other types of opening, e.g. slide-open, devices are also known to be used.

The pierceable portion of the package may be defined, for example, by a so-called "prelaminated" hole, i.e. a hole formed in the base layer of the packaging material before covering the base layer with the layer of barrier material, which is therefore whole and closes the hole to ensure air-tight, aseptic sealing, while still being easily pierceable.

In the case of aseptic packaging machines, the opening devices described, once formed, are normally applied directly to the packages by on-line application units located downstream from the packaging machine.

Application of the opening devices, e.g. by heat sealing or gluing, involves various preliminary operations on both the packages and the opening devices themselves. More specifically, when the opening devices are applied by heat sealing, both the heat-seal outer layer of the packaging material about the holes or pierceable portions of the packages and the opening devices are partly melted or softened locally by preheating.

Once applied to the respective packages, the opening devices must be held firmly on the packages long enough for the contacting materials to cool and to permit adhesion.

Similarly, when the opening devices are glued on, one or both of the parts for gluing must be coated with adhesive, and the parts must be held firmly in contact with each other long enough to permit adhesion.

The above opening devices are known to be produced in the form of plastic sheets defining a matrix of opening devices, i.e. a number of parallel rows of opening devices connected integrally to one another by connecting strips, which are easily broken to first separate the rows one by one from the sheet, and then separate the opening devices one by one from each row.

A need is felt for separating units capable of separating the opening devices one by one from the relative row, and efficiently transferring them continuously, one by one, in orderly manner, and as fast as possible to a follow-up station where they are applied to the top walls of the respective packages.

In particular, a need is felt for separating units comprising as few moving parts as possible, to reduce inertia and simplify manufacture and maintenance of the unit.

Another requirement is gradual acceleration and deceleration of the indispensable moving parts of the unit, to reduce stress caused by shock and inertia.

DISCLOSURE OF THE INVENTION

It is an object of the present invention to provide a separating unit, for separating opening devices supplied in the form of at least one row and to be applied singly to respective packages of pourable food products, designed to satisfy at least one of the above requirements in a straightforward, low-cost manner.

According to the present invention, there is provided a separating unit, for separating opening devices supplied in the form of at least one row and to be applied singly to respective packages of pourable food products, as claimed in claim 1.

BRIEF DESCRIPTION OF THE DRAWINGS

A preferred, non-limiting embodiment of the present invention will be described by way of example with reference to the accompanying drawings, in which:

FIGS. 2 and 3 show larger-scale front views, with parts removed for clarity, of details of the FIG. 1 unit in a first and second operating configuration respectively;

FIG. 5 shows a larger-scale rear view in perspective of details of FIG. 3;

BEST MODE FOR CARRYING OUT THE INVENTION

Figure 1:
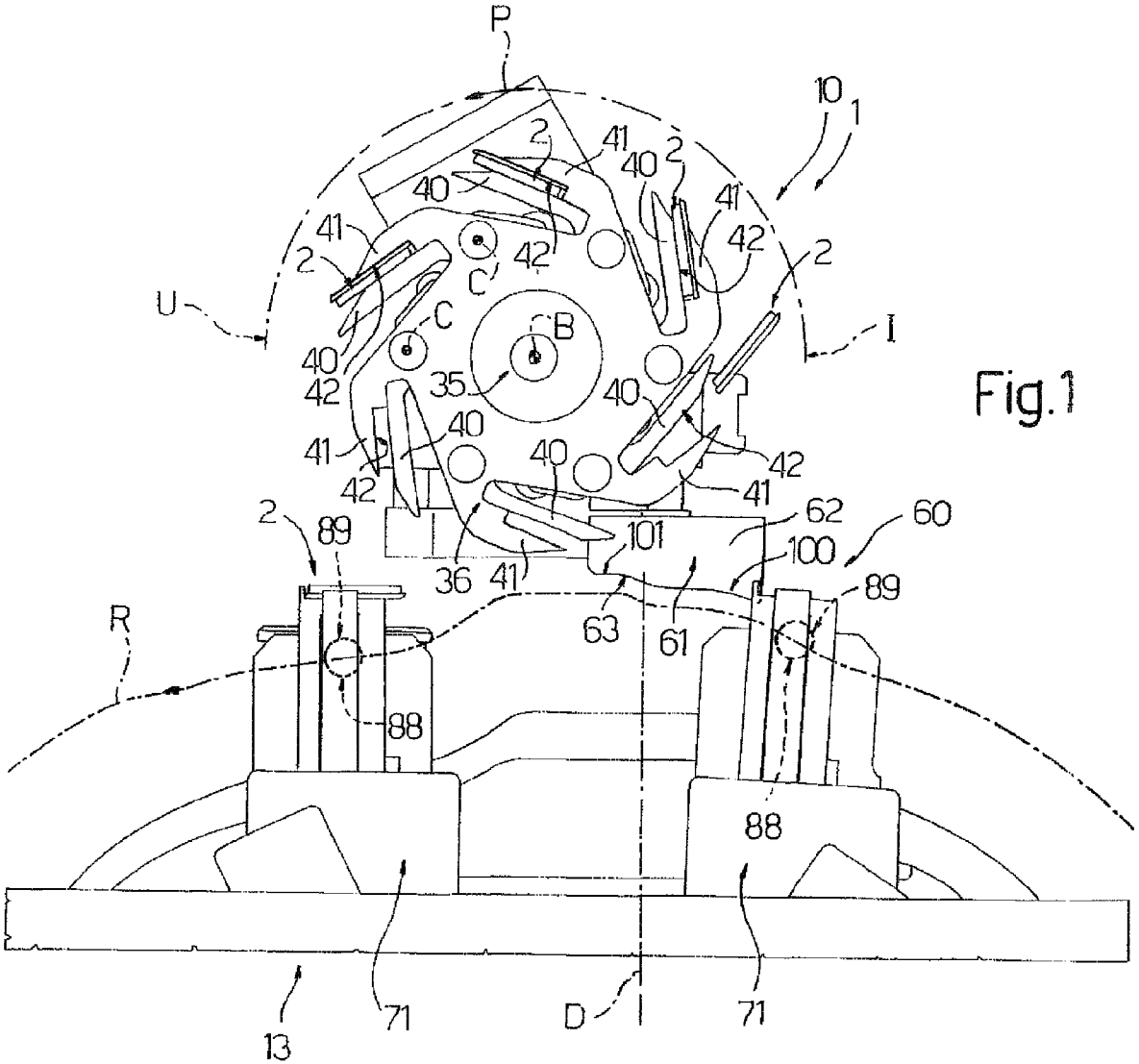
FIG. 1 shows a rear view, with parts removed for clarity, of a separating unit, for separating opening devices to be applied singly to respective packages of pourable food products, in accordance with the present invention.

Number 1 in the accompanying drawings indicates as a whole a separating unit for separating opening devices 2 (FIGS. 2, 3, 4, 6, 9) to be applied singly to respective sealed packages 3 (FIG. 6) of pourable food products.

Packages 3 are produced upstream from unit 1, as described in the introduction, from sheet packaging material comprising a base layer, e.g. of fibrous material such as cardboard, or material such as mineral-filled polypropylene; and a number of layers of heat-seal plastic material, e.g. polyethylene film, covering both sides of the base layer. In the case of aseptic packages 3 for long-storage products, such as UHT milk, the packaging material also comprises a layer of gas- and light- barrier material, e.g. aluminium foil or ethyl vinyl alcohol (EVOH) film, which is superimposed on a layer of heat-seal plastic material, and is in turn covered with another layer of heat-seal plastic material forming the inner face of package 3 eventually contacting the food product.

In the example shown, packages 3 are substantially parallelepiped-shaped, and have on their end walls 4 (FIG. 6) respective openings or pierceable or removable portions (not shown), which are covered outwardly by respective opening devices 2 applied to packages 3 as described below.

Figure 6:
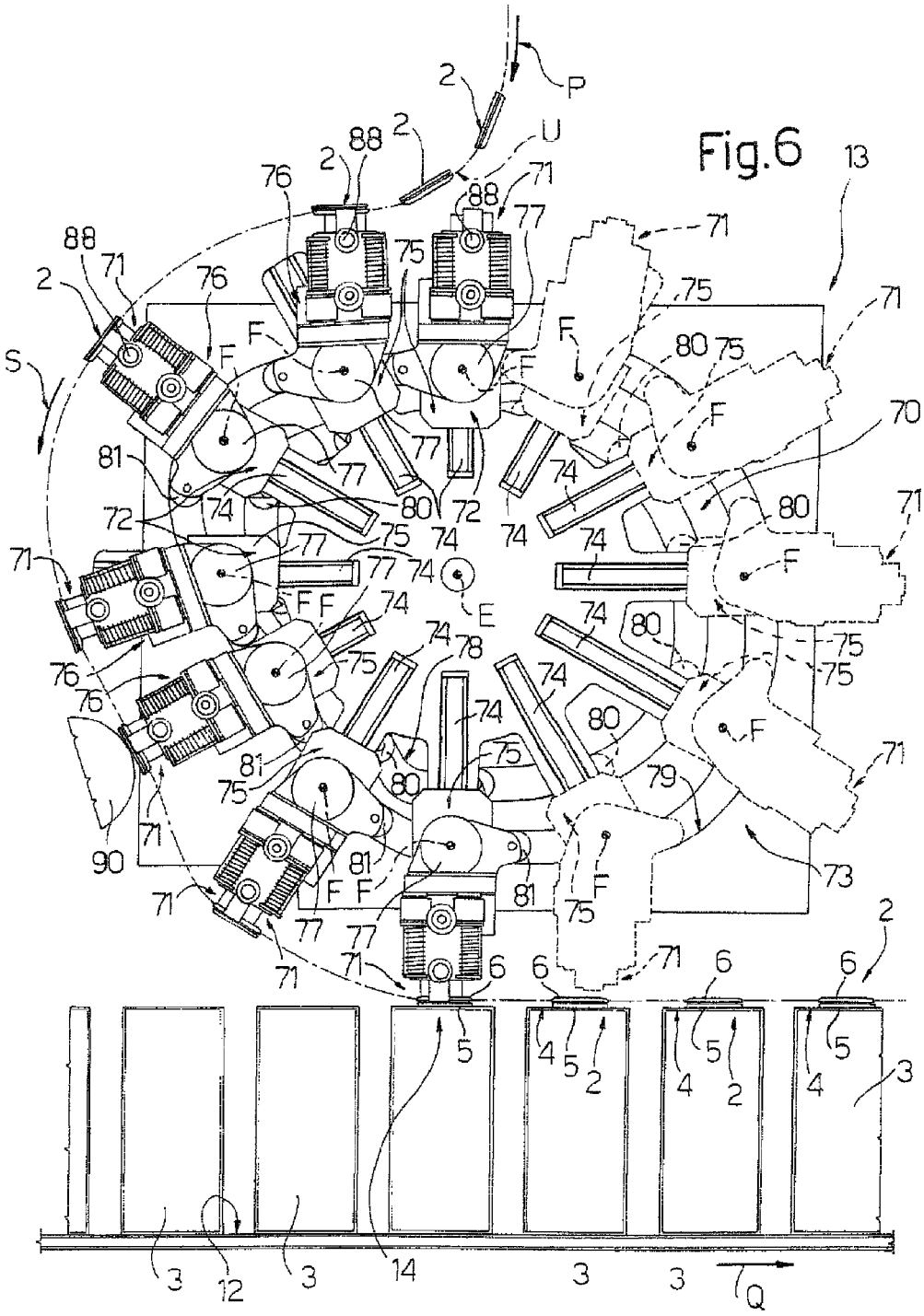
FIG. 6 shows a front view of a conveyor of the unit according to the present invention.

As shown in FIG. 6, opening devices 2 are flat, substantially rectangular, hinged types made of plastic, and each comprise in known manner a frame 5 fixed to wall 4 of a respective package 3 and defining a through pour opening (not shown) for the food product; and a cap 6 hinged to frame 5 to close said opening.

Unit 1 receives, one at a time, a number of rows 7 of opening devices 2 from a first separating assembly 9 (FIG. 9) located upstream from unit 1.

Unit 1 substantially comprises:

- a second separating assembly 10 (FIGS. 1, 2, 3, 4, 5, 9) for receiving rows 7 one at a time from separating assembly 9, dividing each row 7 into individual opening devices 2, and feeding the opening devices 2, one at a time, in steps along an arc-shaped path P extending from a receiving station I for rows 7, to a release station U for opening devices 2;
- a known linear conveyor 12 (FIG. 6), only shown schematically, for feeding a succession of packages 3 along a straight, horizontal path Q; and
- a carousel conveyor 13 (FIGS. 1, 6) for receiving opening devices 2 one at a time from separating assembly 10 at station U of path P, and continuously transferring opening devices 2, one at a time, along an arc-shaped path S to an application station 14 (FIG. 6), along path Q, where opening devices 2 are applied to respective packages 3.

Figure 9:
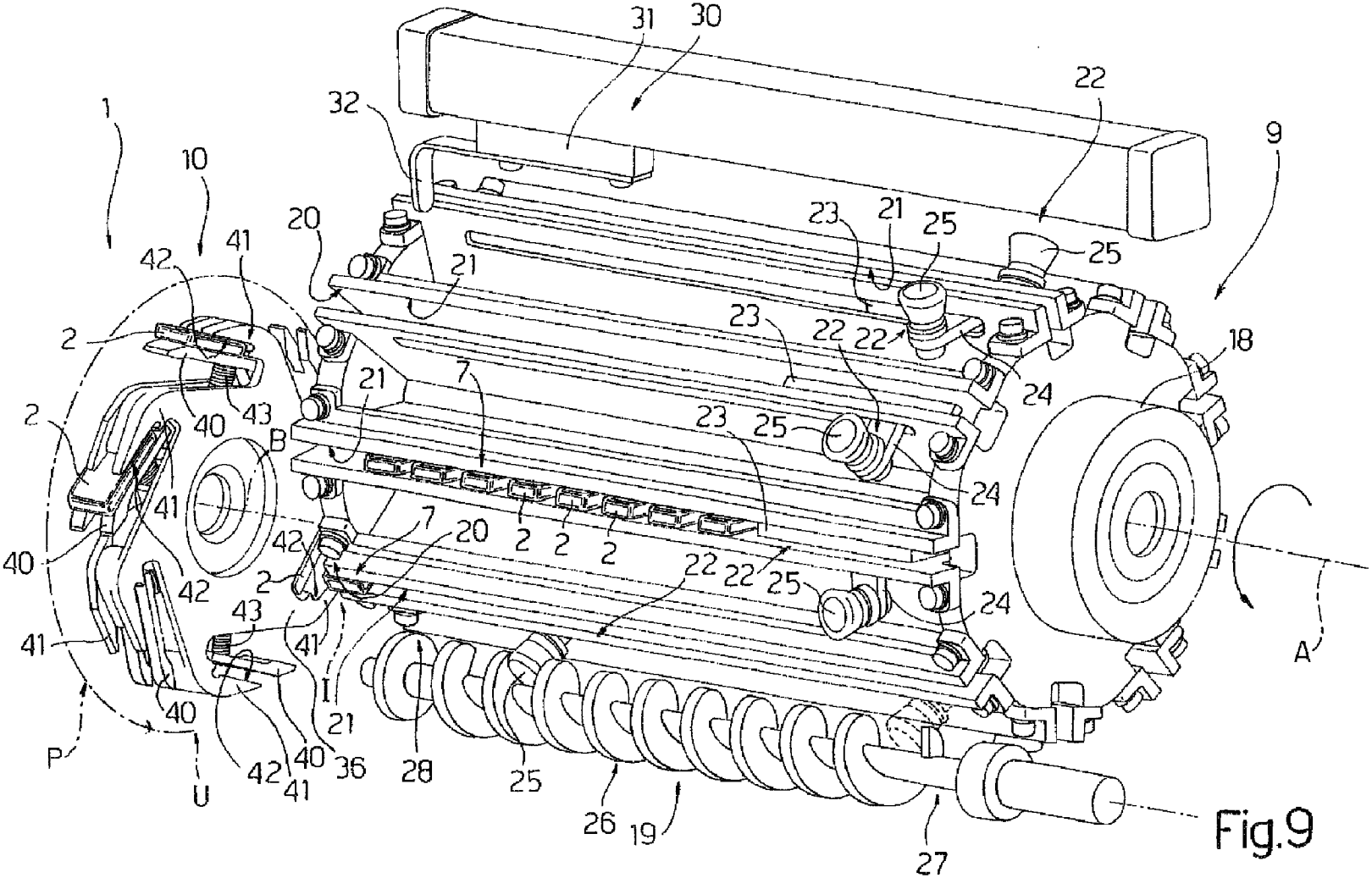
FIG. 9 shows a view in perspective of a separating assembly upstream from the FIG. 1 unit, and of a portion of the unit itself.

With particular reference to FIG. 9, separating assembly 9 is supplied with a sheet of plastic material (not shown) defining a matrix of opening devices 2, i.e. comprising a number of adjacent rows 7.

Separating assembly 9 detaches rows 7 one at a time from the sheet of plastic material, and feeds rows 7 one at a time in steps to separating assembly 10.

Each row 7 detached from the sheet is fed by separating assembly 9 to separating assembly 10, so that the opening device 2 defining one end of row 7 is located at station I of path P.

Separating assembly 9 comprises a drum 18 rotating one-way in steps about an axis A to detach each row 7 from the sheet and feed row 7 along an arc-shaped path; and a feed device 19 for feeding each row 7, detached by drum 18, in a straight direction, parallel to axis A, to separating assembly 10 at station I of path P.

More specifically, drum 18 detaches from the sheet of plastic material the first row 7 defining, at the time, the end of the sheet facing drum 18.

Drum 18 is located axially adjacent to separating assembly 10, is hinged to a fixed supporting shaft to rotate about axis A, and has about its periphery a number of elongated radial slots 21 parallel to, and equally spaced angularly about, axis A, which is horizontal in use.

Drum 18 is powered in a manner not shown.

Each slot 21 is defined by two walls projecting from the periphery of drum 18 radially with respect to, and away from, axis A.

Each slot 21 is open radially, on the opposite side to the periphery of drum 18, to permit insertion of end rows 7 of the sheet one at a time.

Each slot 21 has an open axial end 20 facing separating assembly 10, so each row 7 detached from the sheet can be fed to separating assembly 10 in a direction parallel to axis A; and each slot 21 is open at a second axial end opposite end 20.

Slots 21 are of such a depth as to receive one row 7 at a time, i.e. the first row 7 defining at the time the end of the sheet of plastic material facing drum 18.

Each row 7 is detached from the sheet by drum 18 rotating one step. More specifically, as drum 18 rotates, the rest of the sheet is retained in a manner not shown.

Device 19 comprises, for each slot 21, a pusher 22 which pushes the relative row 7, detached from the sheet, along the inside of slot 21 towards end 20; and a powered worm 26 cooperating cyclically with each pusher 22.

More specifically, each pusher 22 comprises a plate 23 housed inside respective slot 21 to slide parallel to axis A; and a connecting arm 24, which has a first end fixed to plate 23, and a second end, opposite the first, fitted with a roller 25 rotating idly about a respective axis radial with respect to axis A.

Each arm 24 extends through one of the walls of respective slot 21, and projects inside a gap defined between the respective slot 21 and an adjacent slot 21.

Each roller 25 projects outwards of drum 18 and inside a respective gap defined by two adjacent slots 21.

Worm 26 has a tangential inlet 27 engaged by roller 25 of each incoming pusher 22 to device 19; a helical feed portion which, as it rotates parallel to axis A, draws roller 25, and therefore respective row 7, to end 20 of respective slot 21; and an outlet 28 at the axially opposite end to the tangential inlet.

Outlet 28 allows the drawn-along roller 25 to continue rotating in steps about axis A; and the helical portion is interposed axially between inlet 27 and outlet 28 of worm 26.

Separating assembly 9 also comprises a backup station 30 located on the opposite side of axis A to device 19, and which slides each pusher 22, along the inside of respective slot 21 and parallel to axis A, back to the opposite end of slot 21 to end 20.

Very briefly, backup station 30 comprises an actuator 31; and a draw finger 32, which extends radially towards axis A, and cyclically comes to rest against the incoming roller 25, adjacent to end 20, entering station 30.

More specifically, draw finger 32 is drawn by actuator 31, in a direction parallel to axis A, from a first out position adjacent to ends 20 of slots 21, to a second position (not shown) adjacent to the original position of each pusher 22, at the opposite end of slots 21 to ends 20.

Separating assembly 10 (FIGS. 1, 2, 3, 4, 5, 9) substantially comprises a fixed supporting structure 35; and a wheel 36 rotating in steps, with respect to supporting structure 35 (not shown in FIG. 9), about an axis B parallel to axis A.

More specifically, wheel 36 rotates about axis B in the same direction as drum 18, and is fitted integrally with a number of—in the example shown, six—jaws 41 equally spaced angularly about axis B.

Wheel 36 also comprises a number of—in the example shown, six—rocker arms 37 (FIGS. 2, 3, 4) hinged to wheel 36 about respective axes C parallel to and equally spaced angularly about axis B.

Each rocker arm 37 comprises a pin hinged to wheel 36 at respective axis C; a roller cam follower 38; and a jaw 40 radially facing a corresponding jaw 41 to define a seat 42 for a respective opening device 2.

More specifically, jaw 40 is located on the opposite side of axis C to cam follower 38.

Each jaw 40 is also interposed between axis B and the corresponding jaw 41.

Each jaw 40 is therefore rotated by wheel 36 about axis B integrally with the corresponding jaw 41, and is free to rotate, with respect to wheel 36 and about axis C, to and from jaw 41.

Seats 42 also rotate about axis B, and are movable between an open configuration, to permit insertion of respective opening devices 2 at station I, and a closed configuration, in which opening devices 2 are fed from station I to station U along path P.

More specifically, when each seat 42 is in the open configuration, jaws 40, 41 are sufficiently far apart to permit insertion of opening device 2 inside seat 42. At station I, each seat 42 can therefore receive the corresponding opening device 2 projecting from end 20 of slot 21 facing wheel 36 at station I.

From station I, each seat 42 moves, in the closed configuration, along path P to detach the opening device 2 housed inside seat 42 from row 7 and feed opening device 2 to station U.

Separating assembly 10 also comprises a number of—in the example shown, six—helical springs 43 (FIGS. 2, 3, 4, 9) extending radially with respect to axis B, and each interposed between wheel 36 and a corresponding jaw 40.

Springs 43 press jaws 40 towards corresponding jaws 41 to keep respective seats 42 in the closed configuration.

Unit 1 also comprises cam means 60 for moving seat 42, in opposition to respective spring 43, from the closed configuration to the open configuration at station I.

Cam means 60 advantageously comprise a cam 61 operated by carousel conveyor 13 and cooperating cyclically with each cam follower 38 to move relative jaw 40 away from relative jaw 41, in opposition to relative spring 43, and so move relative seat 42 into the open configuration.

Cam means 60 also comprise a cam 46 fixed to supporting structure 35 of separating assembly 10 and cooperating cyclically with each cam follower 38 to begin moving relative jaw 40 away from corresponding jaw 41, and so begin moving respective seat 42 from the closed configuration to the open configuration.

Cam 46 cooperates with each cam follower 38 before cam 61, with reference to the travelling direction of opening devices 2 along path P.

More specifically, supporting structure 35, only shown schematically in the drawings, defines a tubular body 44 (FIGS. 2, 3, 4, 5) surrounding axis B, surrounded by wheel 36, and comprising, in the rotation direction of wheel 36:

- a cylindrical main portion 45 withdrawn radially from rocker arms 37 to avoid interfering with cam followers 38 of rocker arms 37;
- cam 46, which has a surface 47 which cooperates cyclically with each cam follower 38 to rotate relative rocker arm 37 about relative axis C and move relative seat 42, in opposition to relative spring 43, from the closed configuration to the open configuration at station I; and
- a substantially prismatic cavity 50 open in a direction parallel to axis B, and bounded laterally by an end wall 52 of cam 46, and by an end wall 53 of body 44.

More specifically, surface 47 defines an end profile of cam 46 on the opposite side to axis B, and extends, with reference to the travelling direction of opening devices 2 along path P, at increasing radial distances from axis B.

Figure 2:
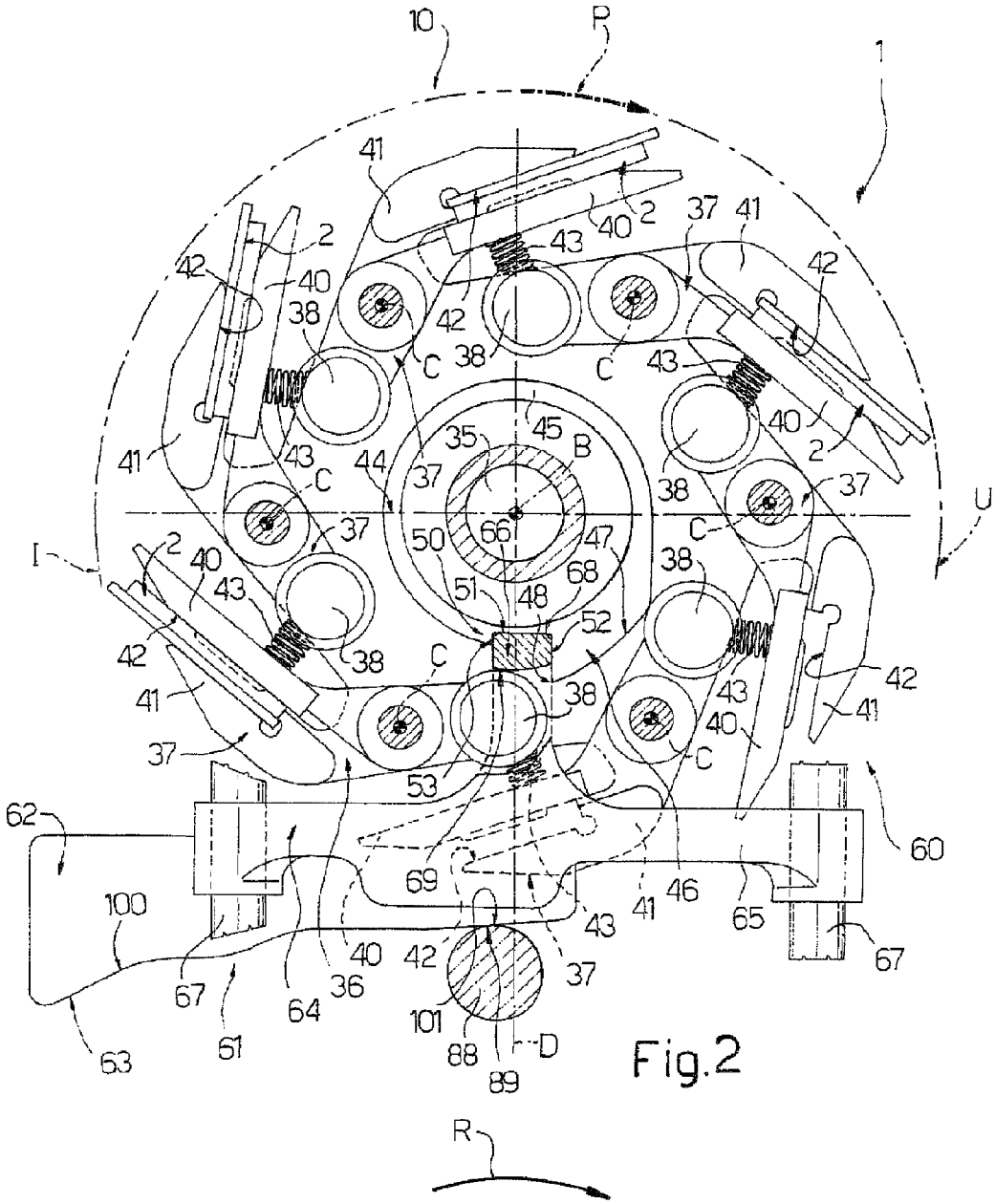
Figure 4:
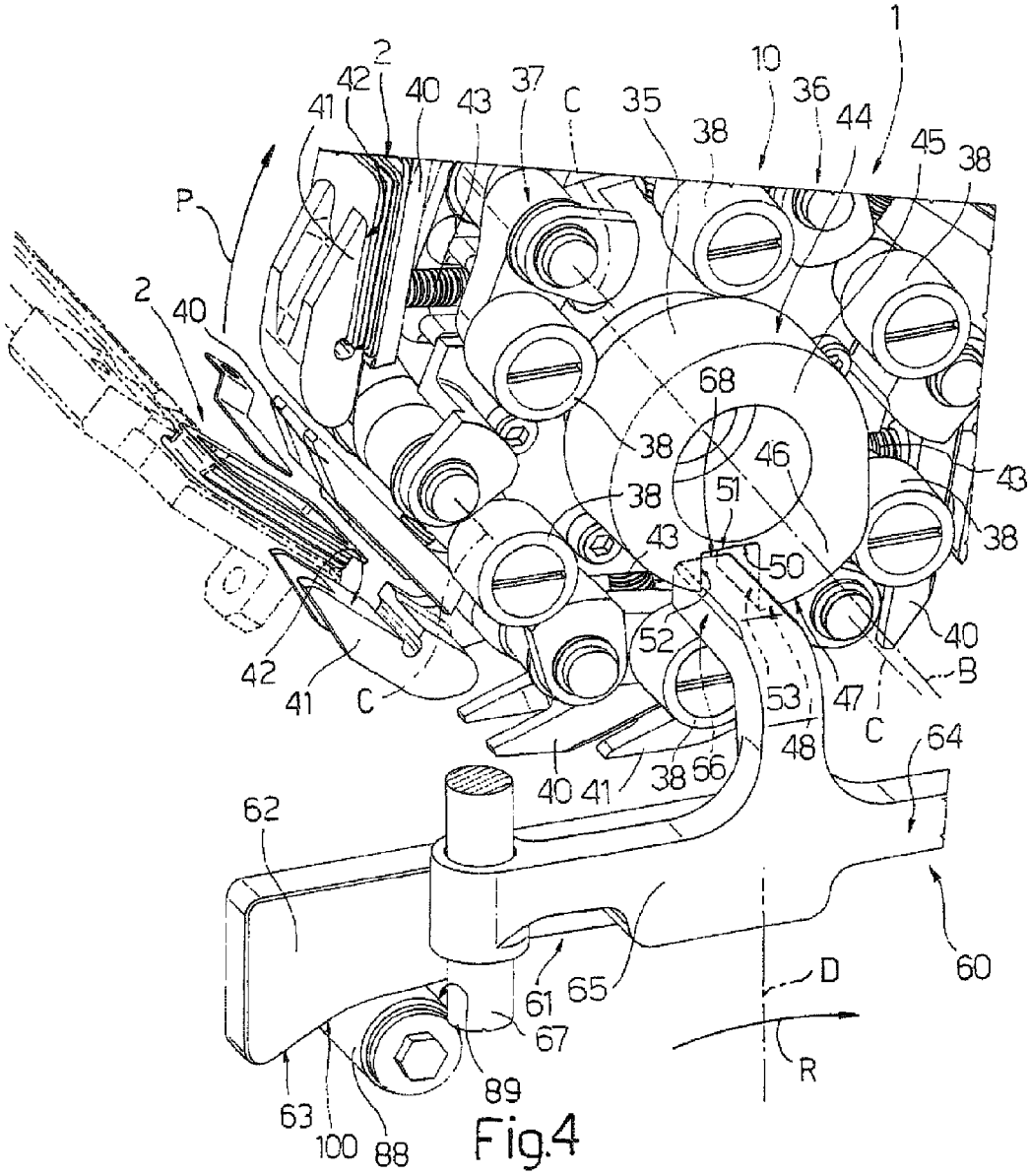
FIG. 4 shows a larger-scale front view in perspective, with parts removed for clarity, of the FIG. 1 unit in the second operating configuration.

As a result, surface 47 moves the cam follower 38, with which it cooperates cyclically, away from axis B to rotate the relative rocker arm 37 clockwise in FIG. 2 about axis C.

This clockwise rotation moves cam follower 38 cyclically away from axis B, and moves relative jaw 40 towards axis B.

Moving towards axis B, jaw 40 moves away from jaw 41 to move seat 42 from the closed configuration to the open configuration.

Cavity 50 is also defined, on the side facing axis B, by a wall 51, of supporting structure 35, parallel to axis B and horizontal in use.

Both walls 52, 53 extend from respective lateral ends of wall 51 and in respective planes perpendicular to and on opposite sides of axis B.

Wall 52 extends from a respective lateral end of wall 51 to an end edge of surface 47 defining a final-contact section 48 between surface 47 and each cam follower 38.

Wall 52 also extends further than wall 53 from wall 51.

Cam 61 is moved by carousel conveyor 13 between an open position (FIGS. 3, 4, 5), in which jaw 40 and corresponding jaw 41 are kept far enough apart to keep relative seat 42 in the open configuration, and a closed position (FIG. 2), in which jaw 40 is moved by respective spring 43 towards corresponding jaw 41 to restore seat 42 to the closed configuration.

More specifically, carousel conveyor 13 and wheel 36 extend at different heights in the same vertical plane, and cam 61 is interposed vertically between axis B and an axis of rotation E of carousel conveyor 13.

Cam 61 slides between the open and closed positions in a direction D intersecting path P and perpendicular to axis B, and is loaded elastically into the open position.

More specifically, direction D is vertical in use.

Cam 61 comprises a plate 62 bounded, on the opposite side to axis B, by a surface 63 which cooperates cyclically in rolling manner with a number of guide members 88 (FIGS. 1, 2, 3, 4, 6, 7), fitted to carousel conveyor 13, so as to translate parallel to direction D; and a plate 64 integral with plate 62 and having, on the side facing axis B, an appendix 66 which cooperates cyclically with each cam follower 38.

Surface 63 extends in direction D at decreasing distances from axis B with reference to an oriented trajectory R of guide members 88, so that each guide member 88, when it cooperates cyclically with surface 63, translates cam 61 in direction D towards axis B.

Plate 64 comprises a main portion 65 perpendicular to axis B; and appendix 66 projects, parallel to axis B, from main portion 65, and is housed inside cavity 50.

More specifically, appendix 66 is bounded, on the side facing axis B, by a surface 68 parallel to axis B, and is bounded, on the opposite side to surface 68, by a curved surface 69.

More specifically, surface 69 extends at increasing radial distances from axis B with reference to the travelling direction of opening devices 2 along path P (FIG. 5), and is shaped to define an extension of surface 47 when cam 61 is in the open position.

The distance between surfaces 68 and 69, and hence the overall size of appendix 66 parallel to direction D, is less than the distance between wall 51 and section 48 of surface 47.

Plate 64 is fitted to two guides 67 (FIG. 3) so as to slide in direction D. More specifically, plate 64 has two lateral arms fitted in sliding manner to respective guides 67.

Each guide 67 is connected elastically to the respective arm of plate 64 by a spring (shown schematically in FIG. 3) which loads cam 61 into the open position.

More specifically, plate 62 and main portion 65 extend in respective parallel planes perpendicular to axis B and vertical in use. More specifically, the plane of plate 62 coincides with the plane of carousel conveyor 13 and wheel 36, while the plane of main portion 65 is spaced apart from said plane; and appendix 66 extends from main portion 65 towards plate 62.

When cam 61 is set to the open position (FIGS. 3, 4, 5) in opposition to relative spring 43, surface 68 is detached from wall 51, and surface 69 is contiguous to surface 47 of cam 46 to define a continuous extension of surface 47.

More specifically, when cam 61 is set to the open position, surface 69 cooperates cyclically, after surface 47, with each cam follower 38.

By defining a continuous extension of surface 47, surface 69 therefore continues to move each cam follower 38 cyclically away from axis B in opposition to relative spring 43, so as to move relative seat 42 completely into the open configuration.

Conversely, when cam 61 is set to the closed position (FIG. 2), surface 68 rests against wall 51, and surface 69 is interposed, in direction D, between wall 51 and section 48.

Consequently, cam follower 38 of each rocker arm 37, after cooperating with surface 47 and as it cooperates with surface 69, is pushed by relative spring 43 towards axis B and stopped against wall 51.

The corresponding rocker arm 37 therefore rotates anticlockwise in FIG. 2 about relative axis C to move relative jaw 40 towards corresponding jaw 41 and so restore relative seat 42 to the closed configuration.

At this stage, surface 69 of appendix 66 is pushed by cam follower 38, parallel to direction D, towards wall 51. And, because cam 61 is loaded elastically into the open position, surface 69 of appendix 66 provides for gradual, controlled rotation of cam follower 38 about axis C, and therefore gradual, controlled movement of seat 42 from the open configuration to the closed configuration.

Carousel conveyor 13 (FIGS. 1, 6) rotates continuously, in the opposite direction to wheel 36, about an axis E parallel to axis B, and picks up opening devices 2 at station U and feeds them along a curved path S to station 14.

Carousel conveyor 13 (FIG. 6) substantially comprises a wheel 70 of axis E; and a number of pickup members 71, which are equally spaced about axis E, are fitted to and project radially from wheel 70, receive respective opening devices 2 at station U, and each have a respective guide member 88 movable cyclically along trajectory R.

Carousel conveyor 13 also comprises a number of connecting assemblies 72 connecting pickup members 71 movably to wheel 70; and cam guide means 73 for varying the position of each pickup member 71 with respect to wheel 70 as wheel 70 rotates.

Connecting assemblies 72 comprise a number of guide members 74 extending radially about axis E and fixed to and projecting from an end surface of wheel 70; and a number of slide members 75 fitted in sliding manner to respective guide members 74, and each supporting a respective pickup member 71.

Each pickup member 71 is fitted to a plate 77, which is hinged to relative slide member 75, on the opposite side to relative guide member 74, and about a respective axis F parallel to axis E and perpendicular to plate 77.

Each pickup member 71 can therefore translate, with respect to wheel 70, in a predetermined radial direction with respect to axis E, and can oscillate, with respect to wheel 70, about a respective axis F perpendicular to and intersecting said radial direction.

Guide means 73 comprise two curved fixed cams 78, 79 extending seamlessly about axis E and cooperating with relative idle cam follower rollers 80, 81 fitted respectively to slide member 75 and plate 77 of connecting assembly 72 of each pickup member 71.

All portions of cam 79 are located radially outwards with respect to cam 78.

In other words, cam 78 controls the radial position of pickup members 71 with respect to axis E as wheel 70 rotates, and cam 79 controls the orientation of pickup members 71, and therefore of opening devices 2, with respect to the radius of wheel 70 to which they are fixed.

As shown in FIG. 6, the position of pickup members 71, and therefore of opening devices 2, varies with respect to wheel 70 as wheel 70 rotates, so that path S and the trajectory R described by guide members 88 about axis E comprise a circular component about axis E, and a translation component radial with respect to axis E.

Each pickup member 71 is fixed to plate 77 by a supporting frame 76, which projects from plate 77 on the opposite side to relative slide member 75.

Figure 7:
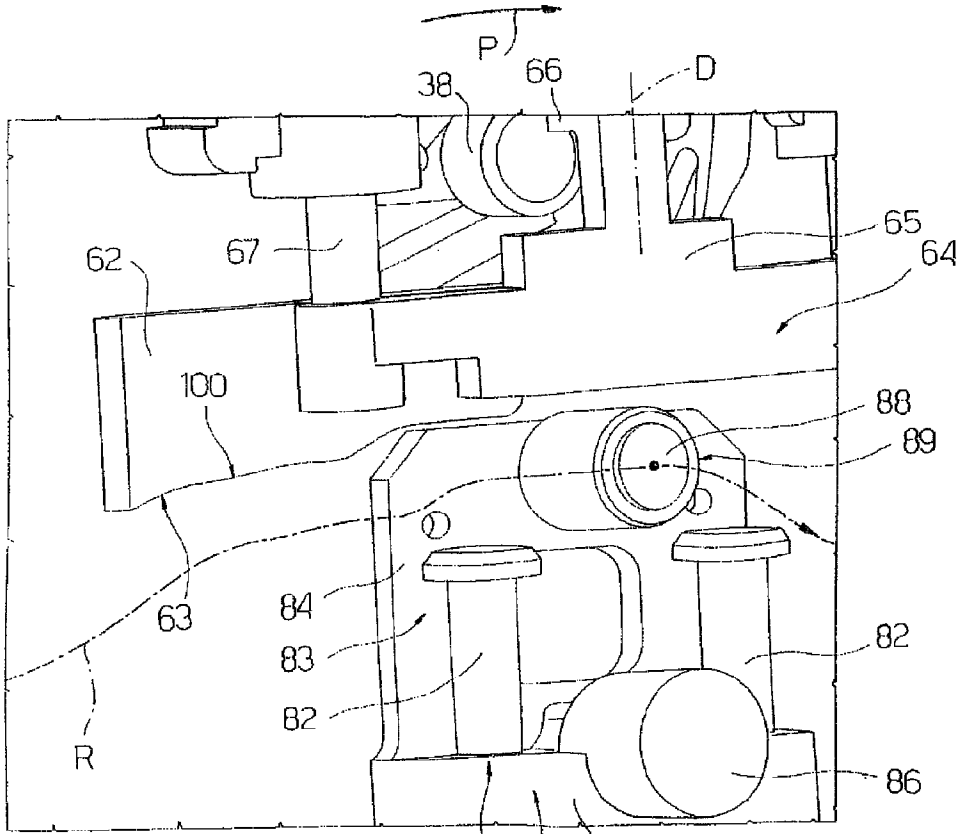
FIG. 7 shows a front view in perspective of further details of FIGS. 5 and 6.

Very briefly, each frame 76 (FIG. 7) comprises a main body (only shown completely in FIG. 6) which is substantially L-shaped in a plane perpendicular to plate 77; two pins 82 extending radially from said main body; and a fastening body 83 (FIG. 7). Each fastening body 83 is fitted integrally with relative pickup member 71, is fitted in sliding manner to pins 82, and is loaded elastically, by respective helical springs (shown in FIG. 1 but not in FIG. 7) coaxial with pins 82, into a withdrawn position, i.e. at a minimum radial distance from axis E with reference to the radial position of relative slide member 75 along relative guide member 74.

More specifically, fastening body 83 of each frame 76 comprises a main plate portion 84 extending parallel to relative plate 77, and fitted with relative projecting pickup member 71 (not shown in FIG. 7 for the sake of simplicity); and an appendix 85 extending perpendicularly from the end of main portion 84 facing axis E, and defining two through holes engaged in sliding manner by respective pins 82.

More specifically, appendix 85 of each frame 76 is fitted with a projecting cam follower roller 86 which cooperates with two fixed cams (not shown) located at station U and station 14. As it rolls along the relative fixed cam, each cam follower roller 86 first moves relative pickup member 71 from the withdrawn operating position to a forward operating position, and then back to its original position.

At the opposite end to relative appendix 85, relative guide member 88 is fitted to and projects from main portion 84 of each frame 76, and comprises an idle roller rotating about a respective axis parallel to axis E, and which is located radially outwards of cam follower roller 86 with respect to axis E.

Each guide member 88 has a circular surface 89 which cooperates cyclically with surface 63 of plate 62.

Figure 8:
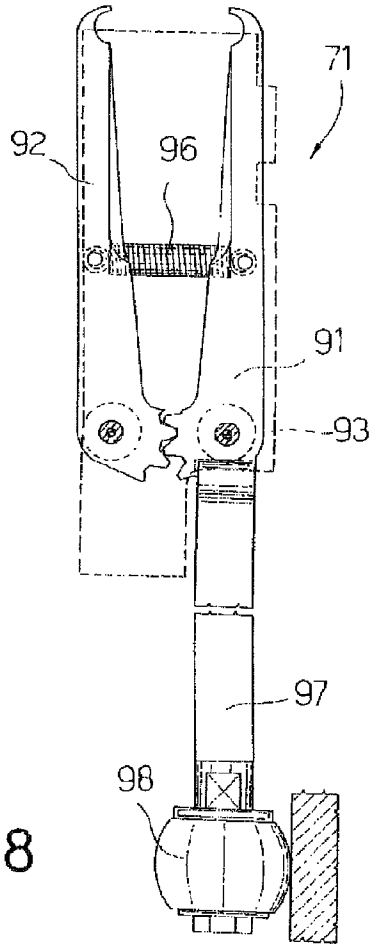
FIG. 8 shows a larger-scale view of a detail in FIG. 6.

As shown in FIG. 8, each pickup member 71 substantially comprises two movable jaws 91, 92 acting on opposite sides of relative opening device 2 to retain it between them.

More specifically, pickup member 71 comprises a supporting body 93 fixed in known manner to frame 76; and jaws 91, 92 are defined by elongated bodies extending along opposite sides of supporting body 93, and having first end portions hinged to supporting body 93 about respective axes perpendicular to axis E, and second end portions opposite the first end portions and which are located radially outwards with respect to axis E, and have substantially arc-shaped tips with their concavities facing to grip and retain a relative opening device 2 in between.

Jaws 91, 92 are loaded elastically towards each other into a closed position by a garter spring 96; and the first end portions of jaws 91, 92 define respective mutually meshing sector gears, one of which (the one defined by jaw 91) is connected integrally to a lever arm 97 fitted with a cam follower roller 98, which cooperates with two fixed cams at respective stations U and 14 to rotate jaws 91, 92 about their respective axes into an open position to engage and release relative opening device 2.

Finally, unit 1 comprises a coating roller 90 (FIG. 6), which interacts with each opening device 2 along path S to apply a given amount of adhesive to a portion of frame 5 of each opening device 2 to be applied to wall 4 of relative package 3.

Operation of unit 1 will now be described with reference to one opening device 2, to relative seat 42, and to a corresponding guide member 88, and as of the instant in which seat 42 is located immediately downstream from station I along path P, and in the closed configuration engaged by opening device 2.

As wheel 36 feeds seat 42 along path P, spring 43 pushes jaw 40 towards jaw 41 to hold seat 42 in the closed configuration.

Rotation of wheel 36 detaches the opening device 2 engaging seat 42 from row 7, which is retained inside respective slot 21 on separating assembly 9.

At station U along path P, a given pickup member 71 grips the opening device 2 between jaws 91, 92, removes it from seat 42, and feeds it along path S.

More specifically, pickup member 71 feeds opening device 2 along path S, so that opening device 2 slides over, and is coated with adhesive by, roller 90 before reaching application station 14.

Close to application station 14, the cam follower roller 86 of pickup member 71 interacts with the relative cam (not shown) to move pickup member 71 into the forward operating position; and, at the same time, jaws 91, 92 are rotated in known manner into the open position to release opening device 2, once it is deposited on a respective package 3.

Downstream from station U, cam follower 38, integral with jaw 40, rolls along surface 47 of cam 46 and is eased away from axis B, thus rotating rocker arm 37 clockwise in FIG. 2 about axis C.

Consequently, jaw 40 also rotates clockwise, in opposition to spring 43, towards axis B and away from jaw 41.

Seat 42 therefore passes from the closed configuration to an intermediate configuration between the closed and open configurations.

Continuous rotation of carousel conveyor 13 and step rotation of wheel 36 are synchronized so that, when cam follower 38 cooperates with section 48 of surface 47, guide member 88 (FIG. 3) cooperates with an initial portion 100 of surface 63.

Portion 100 is shaped to keep cam 61 in the open position, i.e. in which surface 69 of appendix 66 is contiguous to, and defines an extension of, surface 47.

As wheel 36 continues rotating, cam follower 38 therefore rolls along surface 69, which continues moving cam follower 38 away from axis B to move seat 42 into the fully-open configuration.

At this point, wheel 36 is stopped, with seat 42 in the open configuration and located at station I of path P.

Separating assembly 9 feeds the end opening device 2 of row 7 into seat 42 at station I.

More specifically, separating assembly 9 is supplied with the sheet of plastic material defining the matrix of opening devices 2, and the current end row 7 of the sheet of plastic material is fed into a respective slot 21.

Drum 18 is then step-rotated about axis A to detach the end row 7 from the sheet and feed rows 7 to device 19. At this point, roller 25 of the row 7 interacting with device 19 engages worm 26 through inlet 27, and is drawn along, parallel to axis A, by worm 26 to push row 7 to station I of path P. Worm 26 is powered to feed row 7 forward in steps equal to the size of opening devices 2 parallel to axis A, and in time with rotation of wheel 36. And each row 7 is pushed towards input station I so that the current end opening device 2 of row 7 is inserted into the open seat 42.

At the same time, carousel conveyor 13 continues rolling guide member 88 along to cooperate with an end portion 101 (FIG. 2), adjacent to portion 100, of surface 63.

As it rolls along portion 101, guide member 88 translates cam 61 in direction D into the closed position, in which surface 69 is detached from surface 47.

Translation of cam 61 into the closed position allows spring 43 to move cam follower 38 closer to axis B.

Translation of cam 61 into the closed position is partly opposed by cam 61 being loaded elastically into the open position, and so occurs gradually with no shock.

Translation of cam 61 into the closed position terminates upon surface 68 of appendix 66 coming to rest against wall 51.

Seat 42 is now again in the closed configuration, and, as wheel 36 rotates in steps, feeds the new opening device 2 along path P in the same way as described above.

The advantages of unit 1 according to the present invention will be clear from the foregoing description.

In particular, unit 1 uses rotation of carousel conveyor 13 to move seats 42 between the open and closed configurations, with no other drive members required.

As a result, unit 1 is easy and cheap to produce and maintain, by eliminating the need for specific drive members for activating cam 46 and/or cam 61.

By eliminating additional drive members for activating cam 61, unit 1 according to the invention also reduces inertial stress associated with opening and closing seats 42.

As a result, the feed rate of the opening devices along path P can be increased.

Moreover, cam 61 is loaded elastically into the open position.

Consequently, when moving from the closed to the open position to restore seats 42 cyclically to the closed configuration, cam 61 exerts on cam followers 38 a force in opposition to the force exerted on cam followers 38 by respective springs 43.

This is effective in restoring seats 42 gradually to the closed configuration, with no shock and no sharp acceleration or deceleration.

This further reduces inertial stress of unit 1, thus enabling an increase in the feed rate of opening devices 2 along path P.

Clearly, changes may be made to unit 1 as described and illustrated herein without, however, departing from the scope defined in the accompanying Claims.

In particular, cam means 60 need not necessarily comprise cam 46. In which case, each seat 42 is moved from the closed configuration to the open configuration solely by cam 61.

Opening devices 2 may even be heat sealed to respective packages 3; in which case, the adhesive-coating operations are replaced by heating operations performed, for example, upstream from wheel 70 or along path S.

Opening devices 2 may be screw types made of plastic material. In which case, each opening device 2 comprises, in known manner, an externally threaded annular frame which is fixed to the wall of a respective package to define a through pour opening for the food product; and an internally threaded cap screwed to the frame to close the pour opening. And pickup members 71 are designed accordingly to grip screw-type opening devices 2.

Finally, separating assembly 10 may comprise only one rocker arm 37 and, therefore, one seat 42.

The invention claimed is:

1. A unit for separating opening devices supplied in the form of at least one row and to be applied singly to respective sealed packages of pourable food products, comprising:

a separating assembly comprising:

a first and a second jaw movable along a path and defining a seat; said seat being movable between an open configuration, in which the seat receives one of said opening devices from said row at a first station at a start of said path, and a closed configuration, in which the seat moves said opening device singly along said path to detach the one opening device from the rest of said row and feed it to a second station along said path; and elastic means for loading at least said first jaw towards said second jaw to keep said seat in the closed configuration;

a conveyor for conveying said opening devices, the conveyor being separate and independent of said separating assembly; and cam means comprising at least a first cam moved by physically contacting said conveyor and cooperating cyclically with a cam follower integral with said first jaw, to move said first jaw, in opposition to said elastic means, away from said second jaw and move said seat into said open configuration.

2. A unit as claimed in claim 1, wherein said path lies in a plane, and said conveyor comprises a first member, which cooperates cyclically in rolling manner with a second member integral with said first cam, and travels along a trajectory extending about a first axis crosswise to the plane of said path; said first and said second member having a first and a second end profile respectively, which cooperate cyclically with each other, and are so shaped that travel of said first member along said trajectory translates said second member, and therefore said first cam, cyclically in a direction intersecting said path;

said first cam translating cyclically between an open position, in which the first cam cooperates with said cam follower to move said seat into the open configuration in opposition to said elastic means, and a closed position allowing said elastic means to move said first jaw towards said second jaw to move said seat into said closed configuration.

3. A unit as claimed in claim 2, wherein said first cam is loaded elastically into the open position, so that, as said first cam translates into said closed position, said first cam exerts on said cam follower a force in opposition to the force exerted by said elastic means, so as to achieve gradual, controlled movement of said seat from said open configuration to said closed configuration.

4. A unit as claimed in claim 2, wherein said second member is a plate; and said first cam comprises a further plate connected to said second member and having an appendix which cooperates cyclically with said cam follower.

5. A unit as claimed in claim 4, wherein said second member and said further plate lie in respective planes parallel to said direction, and said appendix extends crosswise to said direction.

6. A unit as claimed in claim 2, wherein said first member is a roller; and said second profile extends at increasing distances from said first axis with reference to a travelling direction of each said first member along said trajectory.

7. A unit as claimed in claim 1, wherein said cam means comprise a second cam fitted to said separating assembly and fixed with respect to said path;

said second cam comprising a first end surface, which cooperates cyclically with said cam follower before said first cam, to commence moving said first jaw away from said second jaw in opposition to said elastic means, and to commence moving said seat from said closed configuration to said open configuration.

8. A unit as claimed in claim 7, wherein said separating assembly comprises a wheel rotating about a second axis with respect to said second cam and integral with said second jaw; said first jaw being hinged to said wheel and facing said second jaw; and rotation of said wheel about said second axis causing said first jaw to interact, successively and by way of said cam follower, with said second cam and said first cam.

9. A unit as claimed in claim 8, wherein said separating assembly comprises at least one rocker arm hinged to said wheel about a third axis and fitted, on opposite sides of said third axis, with said first jaw and said cam follower.

10. A unit as claimed in claim 9, wherein said first jaw is interposed radially between said second jaw and said second axis; and said first surface is interposed radially between said second and third axis, and extends, in a travelling direction of said opening devices along said path, at increasing radial distances from said second axis, so as to move said cam follower away from said second axis, move said first jaw towards said second axis, and so move said first jaw away from said second jaw.

11. A unit as claimed in claim 1, said separating assembly supplies said opening devices singly to said conveyor at said second station.

12. A unit as claimed in claim 1, wherein said conveyor transfers said opening devices from said second station to an application station where said opening devices are applied to respective said packages.

13. A unit as claimed in claim 2, wherein said second member is a plate, said first cam comprising a further plate connected to said second member and having an appendix which cooperates cyclically with said cam follower, said separating assembly comprises a wheel rotatable about a second axis with respect to said second cam and integral with said second jaw, said cam means comprising a second cam fitted to said separating assembly and fixed with respect to said path, said second cam comprising a first end surface which cooperates cyclically with said cam follower before said first cam to commence moving said first jaw away from said second jaw in opposition to said elastic means and to commence moving said seat from said closed configuration to said open configuration.

14. A unit as claimed in claim 13, wherein when said first cam is in the open position, said appendix defines a continuous extension of said first end surface to define a single rolling profile for said cam follower; said appendix, when said first cam is in the closed position, being interposed and detached, in said direction, between said second axis and said first surface of said second cam.

15. A unit as claimed in claim 14, wherein said separating assembly comprises a fixed structure supporting said second cam and defining a cavity located downstream from said second cam along said path, and at a distance, in said direction, from said first surface of said second cam; said appendix being housed inside said cavity and being arrested against an end wall of said cavity when said first cam is in said closed position.

16. A unit as claimed in claim 15, wherein said appendix comprises a second and a third surface defining opposite ends of the appendix; said third surface cooperating cyclically with the cam follower; and said second surface cyclically coming to rest against said end wall of said cavity.

17. A unit as claimed in claim 15, wherein said fixed structure integrally defines said cavity and said second cam.

18. A unit for separating opening devices supplied in the form of at least one row and to be applied singly to respective sealed packages of pourable food products, the unit comprising:

a separating assembly comprising: a first and a second jaw movable along a path and defining a seat, the seat being movable between an open configuration, in which the seat receives one of the opening devices from the row at a first station at a start of the path, and a closed configuration, in which the seat moves the opening device singly along the path to detach the one opening device from the rest of the row and feed the one opening device to a second station along the path; and elastic means for loading at least the first jaw towards the second jaw to keep the seat in the closed configuration;

a conveyor for conveying the opening devices, the conveyor being separate and independent of the separating assembly;

cam means comprising at least a first cam activated by the conveyor and cooperating cyclically with a cam follower integral with the first jaw, to move the first jaw, in opposition to the elastic means, away from the second jaw and move the seat into the open configuration;

wherein the path lies in a plane;

wherein the conveyor comprises a first member, which cooperates cyclically in rolling manner with a second member integral with the first cam, and travels along a trajectory extending about a first axis crosswise to the plane of the path;

wherein the first and the second member possess a first and a second end profile respectively, which cooperate cyclically with each other, and are so shaped that travel of the first member along the trajectory translates the second member, and therefore the first cam, cyclically in a direction intersecting the path;

wherein the first cam translating cyclically between an open position, in which the first cam cooperates with the cam follower to move the seat into the open configuration in opposition to the elastic means, and a closed position allowing the elastic means to move the first jaw towards the second jaw to move the seat into the closed configuration;

wherein the second member is a plate, the first cam comprising a further plate connected to the second member and having an appendix which cooperates cyclically with the cam follower, the separating assembly comprises a wheel rotatable about a second axis with respect to the second cam and integral with the second jaw, the cam means comprising a second cam fitted to the separating assembly and fixed with respect to the path, the second cam comprising a first end surface which cooperates cyclically with the cam follower before the first cam to commence moving the first jaw away from the second jaw in opposition to the elastic means and to commence moving the seat from the closed configuration to the open configuration;

wherein when the first cam is in the open position, the appendix defines a continuous extension of the first end surface to define a single rolling profile for the cam follower;

wherein the appendix, when the first cam is in the closed position, being interposed and detached, in the direction, between the second axis and the first surface of the second cam;

wherein the separating assembly comprises a fixed structure supporting the second cam and defining a cavity located downstream from the second cam along the path, and at a distance, in the direction, from the first surface of the second cam; and wherein the appendix being housed inside the cavity and being arrested against an end wall of the cavity when the first cam is in the closed position.

19. A unit for separating an opening device from a row of opening devices, each opening device being configured for application to a sealed package of a pourable food product, the unit comprising:

a separating assembly comprising: a first jaw and a second jaw, the first and second jaws being movable along a path and facing each other so that a seat exists between the facing first and second jaws, the seat being movable between an open configuration in which the seat receives the opening device from the row of opening devices at a first station positioned at a beginning of the path, and a closed configuration in which the seat moves the opening device singly along the path to detach the opening device from the row of opening devices and feeds the detached opening device to a second station positioned along the path, the first jaw comprising a cam follower; and a first spring applying an urging force to the first jaw to push the first jaw toward the second jaw so that the seat is biased to the closed configuration;

a conveyor comprising a guide member fitted to and movable together with the conveyor, the conveyor being configured to move the row of opening devices toward the separating assembly, wherein the conveyor is spaced apart from the separating assembly and moves relative to the separating assembly; and a cam in sliding contact with the guide member, the cam cooperating cyclically with the cam follower to move the first jaw away from the second jaw in opposition to the urging force to shift the seat from the closed configuration to the open configuration.

20. The unit of claim 19, further comprising a second spring applying an urging force to the cam to push the cam toward the guide member so that the cam stays in contact with the guide member as the guide member moves with the conveyor.

* * * * *